United States Patent [19]

Marzoni, Jr.

[11] 4,055,348

[45] Oct. 25, 1977

[54] WORD BUILDING GAME

[76] Inventor: Pettersen B. Marzoni, Jr., P.O. Box 11598, Aspen, Colo. 81611

[21] Appl. No.: 621,340

[22] Filed: Oct. 10, 1975

[51] Int. Cl.[2] ..... A63F 9/04

[52] U.S. Cl. ..... 273/146; 35/71

[58] Field of Search ..... 35/35 R, 35 H, 35 J, 35/69-73; 273/130 E, 131 G, 135 D, 135 E, 136 W, 146

[56] References Cited

U.S. PATENT DOCUMENTS

| | | | |
|---|---|---|---|
| 1,412,204 | 4/1922 | Derby | 35/71 |
| 1,524,529 | 1/1925 | Allen | 273/146 |
| 1,555,447 | 9/1925 | Bernstein | 273/146 |
| 1,584,316 | 5/1926 | Mayhew | 273/146 |
| 1,586,429 | 5/1926 | Kiesling | 273/135 D |
| 2,491,883 | 12/1949 | Welch | 35/71 |
| 3,208,754 | 9/1965 | Sieve | 273/146 |
| 3,393,914 | 7/1968 | Hill | 273/135 D |

FOREIGN PATENT DOCUMENTS

| | | | |
|---|---|---|---|
| 540,876 | 12/1931 | Germany | 35/71 |
| 697,160 | 9/1953 | United Kingdom | 273/146 |

OTHER PUBLICATIONS

"Turntable Scrabble" Advertisement of Selchow & Righter 100th Anniv. Game Catalog, p. 15, Mar. 1968.

"Scrabble Crossword Cubes" Advertisement of Selchow-Righter 100th Anniv. Game Catalog, pp. 12 & 13, Mar. 1968.

*Primary Examiner*—William H. Grieb

*Attorney, Agent, or Firm*—Synnestvedt & Lechner

[57] ABSTRACT

A word building game using a chance device to display letters is disclosed. The chance device displays consonants only, and the players construct words by utilizing consonants displayed through the chance means in appropriate arrangement with any number and variety of vowels of their choice. The frequency of display through the chance device of any consonant with respect to other consonants is in direct and nearly exact ratio to the actual known frequencies of occurrence of the consonants in an extensive stock of words specially compiled from an authoritative listing of the words used most frequently in the vocabulary of a particular language.* In the preferred embodiment, a set of five regular icosahedral dice is used as the chance device, with the consonants on the faces of the dice being those of the English alphabet. Scoring of a constructed word is based both on its length (the total number of letters used) and on the number of displayed consonants employed in its construction. No differential scoring values are assigned to individual letters: all vowels ad consonants have an identical unitary value.

* Such a special word-compilation, for any particular language, is referred to hereinafter as a "stock vocabulary".

3 Claims, 6 Drawing Figures

WORD BUILDING GAME

BACKGROUND OF THE INVENTION

1. Field of the Invention

This invention relates to recreational and educational games and particularly to word building games employing chance means for displaying letters used in the play of the game.

2. Description of Prior Games

Word building games are known, of course. In one such game a plurality of square tiles, each tile bearing one consonant or one vowel, is used. A more or less arbitrarily fixed differential scoring value is assigned to the letter appearing on each tile. A fixed number of tiles is picked at ramdom by each player and the players construct words, in turn, by placing tiles bearing letters forming the desired word on a specially designed game board. The scoring is derived from the length of the formed word, the differential values of the tiles used, and the fortuitous opportunity for placement of tiles in certain bonus areas upon the game board. Games of this type have several significant and disadvantageous differences from that disclosed herein, including, for example:

- at each player's turn, words can be formed only from the limited small number of tiles that the player has before him;
- the player is restricted further in the number, variety, and potential score of the words he can form by the configurations of words (and letters comprising them) already on the game board that have resulted from earlier play during the game;
- the necessity of a game board and many small, individual tiles not only decreases the facile and safe portability of game equipment, but also makes play of the game quite difficult where there usually is not available (e.g., in any moving passenger carrier or in many outdoor circumstances) a suitably-sized, stable surface.

Word games employing a plurality of cubical dice have been proposed. See for example, U.S. Pat. No. 2,491,883 to Welch and U.S. Pat. No. 1,524,529 to Allen. In such games, the faces of the set of dice bear vowels as well as consonants and the frequency of occurrence of any of the letters with respect to the other letters is not in accordance with the expected frequency of occurrence of that letter in a stock vocabulary as defined above. This not only restricts the possible number of letter combinations that can be used, but also skews the distribution of words that can be formed toward those that employ the letters appearing with disproportionately high frequency in the set. Therefore, in some instances differential scoring values must be applied to the letters to compensate for their non-stock vocabulary letter distribution.

SUMMARY OF THE INVENTION

The invention herein disclosed is a word building game employing a chance device for displaying, on a probabilistic basis, consonants in the alphabet of a language. Each of the consonants, or distinct indicia representing each of the consonants, is applied to discrete positions of the chance means, in direct and nearly exact relation to the known frequency of occurrence of that consonant in a stock vocabulary of the language in which the consonants are used. A game is played by constructing words utilizing as many of the displayed consonants as possible, the players constructing the words by arranging the consonants with any number and variety of vowels each player chooses and is able to use. Scoring is computed on the bases both of word length, without the need for assigning differential scoring values to the consonants and vowels used, and of the number of displayed consonants employed. In its more particular aspects, the invention involves a minimal amount of game apparatus for use in word-building games. In one embodiment of the invention, five regular icosahedral dice are utilized. The faces of the dice bear consonants of an alphabet. The number of times a particular consonant appears among the 100 faces is directly and nearly exactly related to the number of times that particular consonant is known to appear in a stock vocabulary of the particular language which employs that alphabet.

DETAILED DESCRIPTION OF THE INVENTION AND PREFERRED EMBODIMENT

Figure 1:
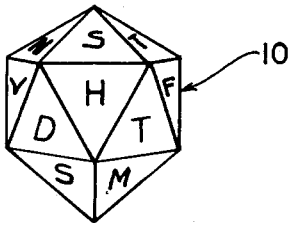

FIG. 1 is a top view of one of five icosahedral dice that are used in the preferred embodiment of the invention.

FIGS. 2A, 2B, 2C, 2D, and 2E are diagrams showing all of the faces of each of the five dice used in the preferred embodiment of the invention.

As set forth above, this invention relates to a word building game, and particularly to apparatus for that game, in which each game participant operates a random chance device that is capable of displaying a selected number of consonants in an alphabet. Words are formed by each participant by arranging two or more of the consonants displayed by the chance device with any number and variety of vowels chosen by the participant or player to form acceptable dictionary words from the vocabulary of the language in which the game is being played. Scoring of the game is based both on the length of the word formed and on the number of consonants displayed by the chance device that is used by a player in forming the word.

An important aspect of the game apparatus of this invention is that the frequency with which a particular consonant appears in the total number of occurrences that the chance device can display bears a direct and nearly exact relationship to the frequency with which that particular consonant actually appears in a stock vocabulary of a particular language. Therefore, it seems necessary here to describe in detail how the consonant distribution for the preferred embodiment is derived. This consonant distribution is based on a statistical study of the written English language, especially as used in America, but it should be realized that the particular procedure used, and the teachings of this invention, are equally applicable for designing like game apparatus for other languages.

Consonant frequencies employed in the design of the game apparatus herein disclosed have been derived from an accurate count of consonant occurrences among specially selected "word-types" compiled in two extensive and parallel sequential probability samples of the first 25,000 word-types in the Rank Listing of the American Heritage Intermediate Corpus (hereinafter AHIC), from the word entitled *The American Heritage Word Frequency Book*, by John B. Carroll, Peter Davies, and Barry Richman, published in 1971 by American Heritage Publishing Co., Inc. and Houghton Mifflin Company (Library of Congress Catalog Card No. 72-181517). The AHIC consists of more than 85,000 word-types encountered in over 5 million "words" or "tokens" of written text. The Rank List is a listing of the word-types of the AHIC in decreasing Standard Frequency Index (SFI) order in the universe of over 5,000,000 words. The SFI is a theoretical measure of the frequency of occurrence of individual word-types in an infinite body of intermediate English-language written text. From the data derived from the AHIC, an SFI has been calculated for each word-type. It is estimated from AHIC statistical data that approximately 97% to 98% of all occurrences of word-types in the AHIC are accounted for among the first 25,000 entries in the Rank Listing. These 25,000 entries extend down to word-types with a theoretical occurrence frequency of about once in a million tokens or words of written text.

To derive the consonant distribution for the preferred embodiment, two independent but parallel 10 percent sequential probability samplings of these first 25,000 word-types in the Rank Listing of the AHIC were undertaken. They comprised, together, a 20 percent sequential probability sampling of these 25,000 entries.

It must be noted that in the design of the sequential probability sampling process certain logical principles relating to the English language and the chance means employed guided decisions concerning which of the listed word-types should be included in the sample consonant-frequency counts and which should be disqualified. These principles and decisions are as follows:

Words employing at least two of the consonants displayed by each and every operation of the chance device disclosed herein can be constructed readily. Consequently, AHIC word-types that contain fewer than two consonants were disqualified and were not included in the consonant-frequency counts.

Words that employ more than five consonants cannot be built employing the preferred embodiment of chance device used in accordance with the game rules disclosed herein. Consequently, AHIC word-types that contain more than five consonants were disqualified and were not included in the consonant-frequency counts.

Very large majorities of plural nouns and singular verb-forms in the English language end in S or *e*S. Moreover, such word-types constitute a considerable fraction of the first 25,000 AHIC entries. It is believed that inclusion in the consonant-frequency counts of these special-purpose uses of S as a terminal letter would create a sustantial and undesirable distortion of its frequency of occurrence in relation to the other consonants. Consequently, AHIC word-types that are plural nouns or singular verb-forms ending in S or *e*S were disqualified and were not included in the consonant-frequency counts. Note, too, that similar exclusions may be advisable for other particular languages (e.g., in German, N as a terminal plural).

There is no apparent feasible method, utilizing the preferred form of chance means disclosed, whereby the indicia used in the chance device can discriminate between upper-case and lower-case letters. Consequently, AHIC word-types that are proper names or ordinarily are capitalized for any reason were disqualified and were not included in the consonant-frequency counts.

The indicia used in the preferred form of chance device include neither punctuation marks nor numerals. Consequently, AHIC word-types with internal punctuation (usually hypens or apostrophes) and AHIC word-types that are numeral-letter combinations were disqualified and were not included in the consonant-frequency counts.

Finally, it is expected that any uncertainties that may arise during the play and scoring of the disclosed game normally will be resolved by recourse to one or another of the current unabridged dictionaries of the English language. Consequently, AHIC word-types with colloquial or dialectal spellings (and misspellings) that are not vocabulary entries in a current unabridged dictionary were disqualified and were not included in the consonant-frequency counts.

More than half of the first 25,000 word-types in the AHIC Rank Listing fall into one or more of these disqualifying categories. Therefore, the consonant-frequency distribution for the preferred embodiment is based on sampling counts of approximately 11,000 acceptable dictionary words that comprise a stock vocabulary of the English language.

It is noteworthy that, although the incidence of disqualification of word-types increased markedly as the samplings were extended down the SFI-ordered listing and the average (mean) number of consonants per acceptable word also trended upward, the frequency distribution of the 20 consonants remained nearly constant throughout the sampling procedures. Progressive and cumulative results of the total 20 percent sampling of the AHIC Rank Listing, at various stages in the sequential process, together with final cumulative results of the two independent 10 percent samples that comprised the 20 percent sampling, are shown in Table I.

TABLE I

| Word-Types | Progressive Data For The Entire 20 Percent Sample | | | | | | Final Data For The Two 10 Percent Samples | |
|---|---|---|---|---|---|---|---|---|
| | | | | | | | #1 | #2 |
| | First | First | First | First | Fifth | First | First | First |
| Listed | 2,500. | 5,000. | 10,000. | 20,000. | 5,000. | 25,000. | 25,000. | 25,000. |
| Sampled | 500. | 1,000. | 2,000. | 4,000. | 1,000. | 5,000. | 2,500. | 2,500. |
| Disqualified # | 150. | 383. | 905. | 2,136. | 664. | 2,800. | 1,392. | 1,408. |
| % | 30.00% | 38.30% | 45.25% | 53.40% | 66.40% | 56.00% | 55.68% | 56.32% |
| Counted Consonants | 350. | 617. | 1,095. | 1,864. | 336. | 2,200. | 1,108. | 1,002. |
| Total Counted | 1,156. | 2,153. | 3,969. | 7,044. | 1,361. | 8,405. | 4,254. | 4,151. |
| Mean Per Word | 3.30 | 3.49 | 3.62 | 3.78 | 4.05 | 3.82 | 3.84 | 3.80 |
| Frequency Distribution | | | | | | | | |
| Total | 100.00% | 100.00% | 100.00% | 100.00% | 100.00% | 100.00% | 100.00% | 100.00% |
| R | 11.94% | 12.35% | 12.22% | 12.45% | 12.64% | 12.48% | 11.84% | 13.13% |
| T | 12.89 | 11.61 | 11.41 | 11.16 | 10.07 | 10.98 | 11.07 | 10.89 |
| N | 11.85 | 11.43 | 11.29 | 10.53 | 12.05 | 10.78 | 11.33 | 10.21 |
| L | 9.00 | 9.15 | 9.25 | 9.60 | 9.33 | 9.55 | 9.73 | 9.37 |
| S | 9.26 | 8.73 | 9.32 | 9.21 | 8.01 | 9.02 | 8.96 | 9.08 |

TABLE I-continued

| | Progressive Data For The Entire 20 Percent Sample | | | | | | Final Data For The Two 10 Percent Samples | |
|---|---|---|---|---|---|---|---|---|
| | | | | | | | #1 | #2 |
| D | 8.13 | 8.08 | 8.36 | 8.82 | 8.38 | 8.75 | 8.23 | 9.27 |
| C | 4.58 | 5.99 | 5.67 | 5.86 | 5.80 | 5.85 | 5.59 | 6.12 |
| P | 4.33 | 4.92 | 4.99 | 4.93 | 5.22 | 4.97 | 4.89 | 5.06 |
| G | 5.02 | 4.97 | 4.86 | 4.87 | 5.14 | 4.91 | 5.29 | 4.53 |
| M | 4.32 | 4.64 | 4.79 | 4.71 | 4.78 | 4.72 | 5.12 | 4.31 |
| H | 5.97 | 4.46 | 4.03 | 4.08 | 3.16 | 3.93 | 3.93 | 3.93 |
| B | 2.59 | 2.65 | 2.85 | 3.08 | 4.19 | 3.26 | 3.15 | 3.37 |
| F | 2.51 | 2.79 | 2.57 | 2.58 | 3.82 | 2.79 | 2.66 | 2.91 |
| W | 2.42 | 2.42 | 2.27 | 2.26 | 1.91 | 2.20 | 2.12 | 2.29 |
| V | 1.64 | 1.72 | 2.29 | 2.17 | 1.98 | 2.14 | 2.28 | 2.00 |
| K | 2.51 | 2.28 | 2.04 | 2.03 | 2.13 | 2.05 | 2.02 | 2.07 |
| X | 0.52 | 0.88 | 0.81 | 0.65 | 0.51 | 0.63 | 0.63 | 0.63 |
| Q | 0.34 | 0.42 | 0.43 | 0.44 | 0.37 | 0.43 | 0.52 | 0.34 |
| Z | 0.09 | 0.37 | 0.30 | 0.34 | 0.22 | 0.32 | 0.33 | 0.31 |
| J | 0.09 | 0.14 | 0.25 | 0.23 | 0.29 | 0.24 | 0.30 | 0.17 |

It must be remarked that several hundreds of thousands of word-types with theoretical occurrence frequencies lower than about one in a million have been excluded from the sampling procedures. It is evident, however, from the sampling of the first 25,000 that a large fraction of these excluded rarely occurring word-types fall into one or another of the disqualifying categories, and it is certain that a very large majority of the remainder are not accessible easily (if at all) in the vocabularly of the average individual.

Moreover, the marked stability of the frequency distribution of the 20 English-language consonants across word-types from the first 2500 most common through the final 5000 sampled and counted, as well as between the two independent 10 percent samples, argues strongly that a more extensive count would not alter significantly this infrastructural characteristic of the written English language.

Therefore, it is concluded that the consonant-frequency distribution derived for the preferred embodiment from the stock vocabulary employed meets the criteria of both validity and reliability in the formal statistical meanings of these terms.

As mentioned above, the game is played by deriving the consonants to be used in building a word from a display of a chance device. In the preferred embodiment, the chance device is a set of five icosahedral dice. A top view of one die 10 of the set is shown in FIG. 1. It should be noted that each die has twenty equilateral triangular faces, all of equal size. Each of the faces defines an indicia-bearing area, as shown in FIGS. 2A–2E, and, with one exception to be noted below, each face of each of the five dice bears a single indicia character, such as the English-language consonants shown in the drawings.

Each die is in the form of a regular icosahedron having twenty equilateral triangular faces arranged in ten opposing pairs. There are several advantages arising from the use of the regular icosahedral shape. When rolled, each die always will come to rest on one of its faces, thereby presenting the opposing face upwardly, making it an easy matter to identify which of the indicia is appropriate to employ in building a word. In addition, the probability in a single roll of one die that a particular face will be uppermost is the same for each of the faces of the die, namely one in twenty. Also, because the icosahedron has twenty faces, it affords the opportunity for presenting a greater amount of information in comparison to the four other regular polyhedral forms (with only 4, 6, 8, and 12 faces, respectively).

Figure 2A:
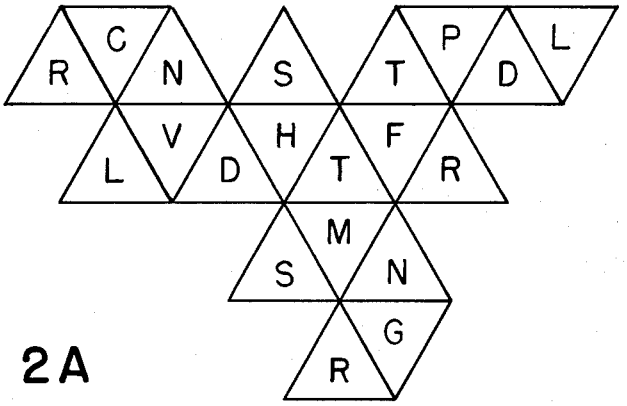
Figure 2B:
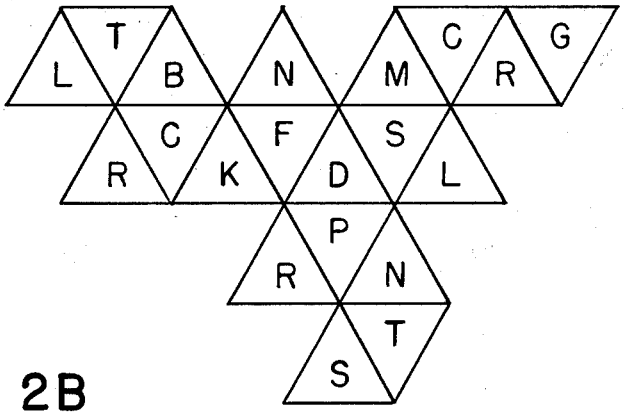
Figure 2C:
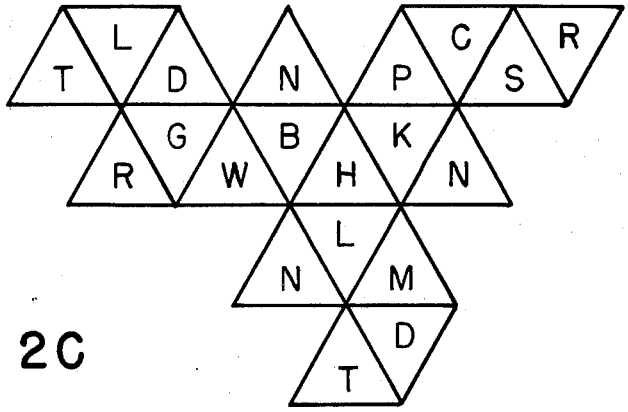
Figure 2D:
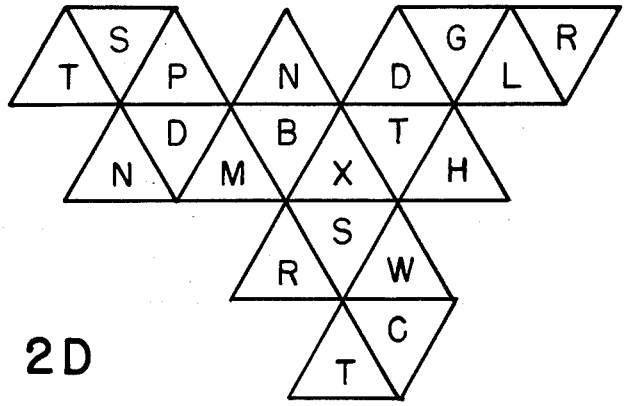
Figure 2E:
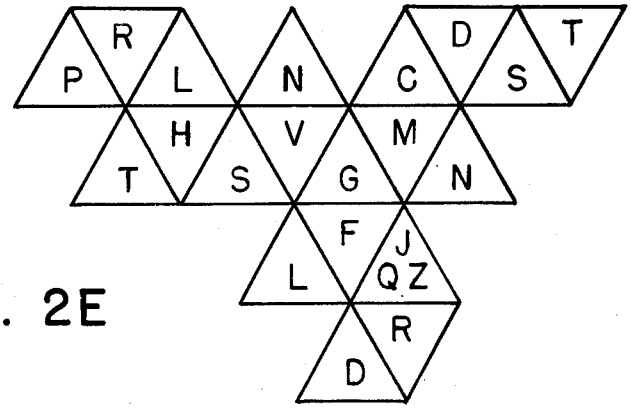

Although not necessary, it is desirable that all five dice be of essentially the same size and weight. The dice can be constructed in any suitable manner, of any suitable material, it being expected that the dice will be fashioned in a solid, durable substance with the indicia embossed or engraved on the faces. It also may be desirable to distinguish each of the dice, one from the other, for example, by use of five distinguishing colors. In a preferred embodiment, one of the dice, for example that shown in FIG. 2A, is violet; another, for example that shown in FIG. 2B, is indigo; another, for example that shown in FIG. 2C, is red; another, for example that shown in FIG. 2D, is green; the last, for example that shown in FIG. 2E, is orange.

The use of five icosahedral dice yields a total of 100 faces to which indicia can be applied. In view of the results of the consonant distribution determined in Table I, among the total of 100 faces, the consonants are applied to the faces as shown in Table II.

TABLE II

| Consonant Distribution | No. of Faces |
|---|---|
| Total | 100 |
| R | 12 |
| T | 11 |
| N | 11 |
| L | 9 |
| S | 9 |
| D | 9 |
| C | 6 |
| P | 5 |
| G | 5 |
| M | 5 |
| H | 4 |
| B | 3 |
| F | 3 |
| W | 2 |
| V | 2 |
| K | 2 |
| X | 1 |
| Q, Z, J | 1 |
| Total | 100 |

The numbers of faces allocated for the several consonants as set out in Table II correspond, as nearly as possible, to the integers closest to the consonant-occurrence rates of the consonants in the sample of 25,000 AHIC word-types set out in Table I. Thus the probability of occurrence of one of the twenty consonants as allocated among the die faces is directly related to the frequency of occurrence of that consonant in a stock vocabulary of the English language.

In the preferred embodiment, the consonants are allocated among the dice in accordance with Table III.

TABLE III

| Consonant | Violet | Indigo | Red | Green | Orange |
|---|---|---|---|---|---|
| R (12) | 3 | 3 | 2 | 2 | 2 |
| T (11) | 2 | 2 | 2 | 3 | 2 |
| N (11) | 2 | 2 | 3 | 2 | 2 |
| L (9) | 2 | 2 | 2 | 1 | 2 |
| S (9) | 2 | 2 | 1 | 2 | 2 |
| D (9) | 2 | 1 | 2 | 2 | 2 |
| C (6) | 1 | 2 | 1 | 1 | 1 |
| P (5) | 1 | 1 | 1 | 1 | 1 |
| G (5) | 1 | 1 | 1 | 1 | 1 |
| M (5) | 1 | 1 | 1 | 1 | 1 |
| H (4) | 1 | — | 1 | 1 | 1 |
| B (3) | — | 1 | 1 | 1 | — |
| F (3) | 1 | 1 | — | — | 1 |
| W (2) | — | — | 1 | 1 | — |
| V (2) | 1 | — | — | — | 1 |
| K (2) | — | 1 | 1 | — | — |
| X (1) | — | — | — | 1 | — |
| Q/Z/J (1) | — | — | — | — | 1 |
| Totals (100) | (20) | (20) | (20) | (20) | (20) |

It should be noted that this allocation is designed to distribute the number of occurrences of each consonant as evenly among the dice as possible. It is important to distribute the consonants in this manner so that the probability of display of each of the consonants during play of the game corresponds as nearly exactly as possible to the frequency of occurrence of that consonant in a stock vocabulary.

With respect to the assignment of particular consonants to the faces of the dice, it should be noted that a formal statistical randomness of assignment can be made. In this context, the arrangements of consonants shown in FIGS. 2A–2E represent only one arbitrary example for each of the dice of many possible and statistically sound arrangements. It should be understood, however, that the dice depicted in FIGS. 2A–2E have a consonant allocation scheme in accordance with Table III.

With respect to the die faces in FIG. 2E, it should be noted that one of the faces bears the three consonants J, Q, and Z. This is the only face in the set that bears more than one consonant. The three consonants have been placed on a single die face because the occurrence frequency for any one of them, from the Table I determination, is substantially less than 1 percent but, together, their frequencies total almost exactly 1 percent.

In a simultaneous or seriatum throw of all five of the dice described herein, any one of 31,816 different five-consonant combinations may be presented for play. The most frequent of these combinations — R T N L S — has an expected occurrence rate of only 72 appearances in 50,000 throws.

Expected occurrence of specific consonants per 1000 throws is shown in Table IV.

TABLE IV

| | Expected Occurrences Per 1000 Throws | | | |
|---|---|---|---|---|
| Constant | Not At All | As Singleton | As Doubleton | As Triplet + |
| R | 526.702 | 361.463 | 97.875 | 13.960 |
| T | 557.685 | 346.275 | 85.050 | 10.990 |
| N | 557.685 | 346.275 | 85.050 | 10.990 |
| L | 623.295 | 309.825 | 60.750 | 6.130 |
| S | 623.295 | 309.825 | 60.750 | 6.130 |
| D | 623.295 | 309.825 | 60.750 | 6.130 |
| C | 733.056 | 235.778 | 29.331 | 1.835 |
| P | 773.781 | 203.627 | 21.434 | 1.158 |
| G | 773.781 | 203.627 | 21.434 | 1.158 |
| M | 773.781 | 203.627 | 21.434 | 1.158 |
| H | 814.506 | 171.475 | 13.538 | 0.481 |
| B | 857.375 | 135.375 | 7.125 | 0.125 |
| F | 857.375 | 135.375 | 7.125 | 0.125 |
| W | 902.500 | 95.000 | 2.500 | — |
| V | 902.500 | 95.000 | 2.500 | — |
| K | 902.500 | 95.000 | 2.500 | — |

TABLE IV-continued

| | Expected Occurrences Per 1000 Throws | | | |
|---|---|---|---|---|
| Constant | Not At All | As Singleton | As Doubleton | As Triplet + |
| X | 950.000 | 50.000 | — | — |
| Q/Z/J | 950.000 | 50.000 | — | — |

While the foregoing description of the preferred embodiment is based on five icosahedral dice, it should be realized that other chance devices having probabilistic occurrence frequencies the same or similar to the five icosahedral dice can be utilized. For example, five chance spinners, having twenty divisions each and a consonant distribution as set out in Table III could be used. Electrically driven chance devices having randomly stopping drums or tapes also could display the consonants in analogous probabilistic fashion.

After this description of the game apparatus of the invention and its design, a desired plan for game play utilizing the English language can be illustrated. It should be realized that the game can be played by one person alone, or by any number of persons in a group, either individually or in teams.

The first step taken by a player is to roll or shake the five dice, preferably all at once, so that they finally come to rest on a reasonably flat, level surface with one of the faces of each of the five dice presented uppermost. The player then attempts to build one word by interspersing, ad libitum, any usable number and variety of the six vowels (A, E, I, O, U, Y) before, after, between, or among two or more of the consonants presented at each throw. Only those consonants displayed uppermost by the dice can be used.

In the preferred game embodiment, certain basic rules must be followed to conform to the consonant-frequencies employed. They are as follows:

The consonant displayed on the uppermost face of each die after a throw may be used only once in building a word during that play. It is possible that the same consonant will be displayed by two or more dice. That consonant may be used as many times as it appears. If, for example, three of the dice display the consonant T then the player may use one, two, or three T's in building his word.

Colloquial or dialectal spellings (and misspellings) of words are not acceptable unless they can be found as vocabulary entries in a current unabridged dictionary.

Neither S nor *e*S may be used to complete a word if they transform a noun from singular to plural or a verb-form from plural to singular.

This rule will not mandate against such singular nouns as PH*y*S*i*CS or S*e*R*ie*S, but it disqualifies such nouns as N*i*GHTS and P*o*T*a*T*oe*S and such verb-forms as C*o*NJ*oi*NS and TR*ie*S.

Other plural noun endings (e.g., *i*M, *e*N, etc.), words ending naturally in S (e.g., F*a*M*ou*S), and other common word endings (e.g., *i*NG, T*io*N, *e*D, N*e*SS, etc.) all are acceptable.

All words with internal punctuation — usually hyphens or apostrophes — are not acceptable. X-Ray AND D*o*N'T are familiar examples.

Numeral-letter combinations (e.g., 7TH) cannot be built.

A single face of the Orange die bears the three very low-frequency consonants J, Q, and Z. When this face is displayed after a throw, the participant may use any one, but only one, of these three consonants in building his word.

At least two of the consonants displayed after a throw must be used to complete a play. However, these consonants need not be different. If, for example, two of the dice display the consonant T, the word T - *o* - T is acceptable.

Proper names and other words ordinarily capitalized are not acceptable.

In accordance with the preferred scoring scheme, each acceptable dictionary word built by a player is awarded a score based on the total number of letters in the word and the number of displayed consonants (≧2) employed in the word. For acceptable words (employing two or more consonants), the scoring formula is $S=N \times 2^{(n-2)}$ in which S is the score, N is the total number of letters in the word and $n$ is the number of consonants used. An illustration using the combination of the consonants R, C, M, H, and B is given in Table V.

TABLE V

| Word Built | Total Number of Letters | Number of Displayed Consonants Used | Multiple | Score |
|---|---|---|---|---|
| He | 2 | 1 | 0 | 0 |
| eRa | 3 | 1 | 0 | 0 |
| aRia | 4 | 1 | 0 | 0 |
| HaM | 3 | 2 | 1 | 3 |
| aCHe | 4 | 2 | 1 | 4 |
| HoaRy | 5 | 2 | 1 | 5 |
| uReMia | 6 | 2 | 1 | 6 |
| CoMB | 4 | 3 | 2 | 8 |
| BeaCH | 5 | 3 | 2 | 10 |
| aMeRCe | 6 | 3 | 2 | 12 |
| MaRCH | 5 | 4 | 4 | 20 |
| CHRoMe | 6 | 4 | 4 | 24 |
| aBRoaCH | 7 | 4 | 4 | 28 |
| BaRouCHe | 8 | 4 | 4 | 32 |
| CHaMBeR | 7 | 5 | 8 | 56 |
| CHeRuBiM | 8 | 5 | 8 | 64 |

It also should be realized that the game can be played with one person (for example, a class instructor) who rolls the dice and a large number of people (for example, a group of students) who build words from the consonant combinations presented at each roll of the dice.

It can be seen from the foregoing that according to the invention herein disclosed, the game apparatus is easily portable and does not require a large area for play. One needs only a flat surface large enough for holding the five dice and any convenient paper and writing instrument for recording the progressive scoring during play. In addition, there is a simplicity of play and scoring that allows persons of all ages to grasp the game easily. The number of combinations possible encompasses nearly all of the limitless variety and complexity of the English language. The game has both entertainment value and educational value and can be used for expanding the players' vocabularies and improving their spelling.

I claim:

1. Game apparatus comprising a chance device having five chance elements, the chance device including means defining a plurality of indicia-bearing areas, each chance element having twenty indicia-bearing areas, a set of indicia characters having a distinct character for representing each consonant of the English alphabet, there being at least one indicia character on each of said discrete indicia-bearing areas as follows:

indicia representing the consonant R on 12% of the indicia-bearing areas,
indicia representing the consonant T on 11% of the indicia-bearing areas,
indicia representing the consonant N on 11% of the indicia-bearing areas,
indicia representing the consonant L on 9% of the indicia-bearing areas,
indicia representing the consonant S on 9% of the indicia-bearing areas,
indicia representing the consonant D on 9% of the indicia-bearing areas,
indicia representing the consonant C on 6% of the indicia-bearing areas,
indicia representing the consonant P on 5% of the indicia-bearing areas,
indicia representing the consonant G on 5% of the indicia-bearing areas,
indicia representing the consonant M on 5% of the indicia-bearing areas,
indicia representing the consonant H on 4% of the indicia-bearing areas,
indicia representing the consonant F on 3% of the indicia-bearing areas,
indicia representing the consonant B on 3% of the indicia-bearing areas,
indicia representing the consonant W on 2% of the indicia-bearing areas,
indicia representing the consonant V on 2% of the indicia-bearing areas,
indicia representing the consonant K on 2% of the indicia-bearing areas,
indicia representing the consonant X on 1% of the indicia-bearing areas,
and indicia representing the consonants J, Q and Z on 1% of the indicia-bearing areas.

2. Game apparatus as in claim 1 wherein the chance means comprises five icosahedral dice.

3. Game apparatus as in claim 2 wherein, among the total of 100 faces of the five dice, there are 12 faces bearing the letter R,
11 faces bearing the letter T,
11 faces bearing the letter N,
11 faces bearing the letter L,
9 faces bearing the letter S,
9 faces bearing the letter D,
6 faces bearing the letter C,
5 faces bearing the letter P,
5 faces bearing the letter G,
5 faces bearing the letter M,
4 faces bearing the letter H,
3 faces bearing the letter B,
3 faces bearing the letter F,
2 faces bearing the letter W,
2 faces bearing the letter V,
2 faces bearing the letter K,
1 face bearing the letter X,
and 1 face bearing the letters Q,Z,J.

* * * * *